US008292631B2

(12) United States Patent
Ma

(10) Patent No.: US 8,292,631 B2
(45) Date of Patent: Oct. 23, 2012

(54) LOW PROFILE ELECTRICAL CONNECTOR

(75) Inventor: Hao-Yun Ma, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/946,867

(22) Filed: Nov. 16, 2010

(65) Prior Publication Data

US 2012/0122346 A1 May 17, 2012

(51) Int. Cl.
*H01R 12/00* (2006.01)

(52) U.S. Cl. ..... 439/66; 439/242

(58) Field of Classification Search ..... 439/65, 439/66, 70, 71, 81, 83, 342
See application file for complete search history.

(56) References Cited

U.S. PATENT DOCUMENTS 2,240,658 A * 5/1941 Mathern ..... 439/858
6,663,409 B1 12/2003 Liao et al.
6,676,431 B2 * 1/2004 Kukita et al. ..... 439/342
7,001,198 B2 * 2/2006 He et al. ..... 439/342
7,198,493 B2 * 4/2007 Chen et al. ..... 439/66
7,661,976 B2 * 2/2010 Ma ..... 439/342
7,828,558 B2 * 11/2010 Ma ..... 439/66
7,841,859 B2 * 11/2010 Liao et al. ..... 439/65

* cited by examiner

*Primary Examiner* — Thanh Tam Le

(74) *Attorney, Agent, or Firm* — Wei Te Chung; Ming Chieh Chang

(57) ABSTRACT

An electrical connector includes an insulative housing and a number of electrical contacts secured to the insulative housing. The insulative housing has a pair of opposite top surface and bottom surfaces. Each electrical contact includes a retaining section received in the insulative housing, a flat offset section bending from a top end of the retaining section and extending along the top surface of the insulative housing, a soldering section bending from a bottom end of the retaining section, and a cantilevered contact arm bending downwardly from the offset section and projecting into the insulative housing.

4 Claims, 8 Drawing Sheets

LOW PROFILE ELECTRICAL CONNECTOR

BACKGROUND OF THE INVENTION

1. Field of the Invention

The present invention relates to an electrical connector, especially to a low profile electrical connector.

2. Description of Related Art

Central Process Unit (CPU) sockets are widely used for establishing electrical connection between CPU and a printed circuit board (PCB). Therefore, CPU sockets are mounted on motherboards and hold CPUs execution of programs. Several types of CPU sockets are available with different structures. For example, a type of Pin Grid Array (PGA) socket is found in U.S. Pat. No. 6,663,409 issued to Liao et al. on Dec. 16, 2003.

A PGA socket generally comprises a base, a moveable cover mounted on the base, an actuator arranged between the base and the cover and a plurality of contacts received in the base. The base defines a plurality of passageways and the cover defines a plurality of through holes corresponding to the passageways. When the PGA socket connects the CPU to the PCB, the CPU is disposed upon the cover with its pins inserted into the through holes of the cover and the passageways of the base. The pins will contact with the contacts after a movement of the cover under a force from the actuator. Since the PGA socket is equipped with a cover, the height thereof is increased accordingly. Furthermore, the contacts are received in the base which causes the height of the electrical connector must more than that of the contacts which is also unfavorable to low profile of the electrical connector.

In view of foregoing, an improved electrical connector is needed to overcome the above-mentioned shortcomings.

BRIEF SUMMARY OF THE INVENTION

Accordingly, an object of the present invention is to provide a low profile electrical connector.

An electrical connector comprises an insulative housing and a plurality of electrical contacts secured to the insulative housing. The insulative housing has a top surface and a bottom surface opposite to each other and defines a plurality of receiving holes extending therethrough. Each electrical contact includes a retaining section received in the receiving hole, an offset section bending from a top end of the retaining section and extending along the top surface of the insulative housing, a soldering section bending from a bottom end of the retaining section, and a cantilevered contact arm bending downwardly from the offset section and projecting into the receiving hole.

An electrical connector comprises an insulative housing and a plurality of electrical contacts secured to the insulative housing. The insulative housing has a top surface and a bottom surface opposite to each other and defines a plurality of receiving holes extending therethrough. The electrical contact includes an offset section contacting with the top surface of the insulative housing, a retaining section bending downwardly from the offset section and received in the receiving hole, a soldering section extending from the retaining section, and a cantilevered contact arm bending downwardly from the offset section and projecting into the receiving hole.

Other objects, advantages and novel features of the invention will become more apparent from the following detailed description of the present embodiment when taken in conjunction with the accompanying drawings.

DETAILED DESCRIPTION OF THE PREFERRED EMBODYMENT

Figure 1:
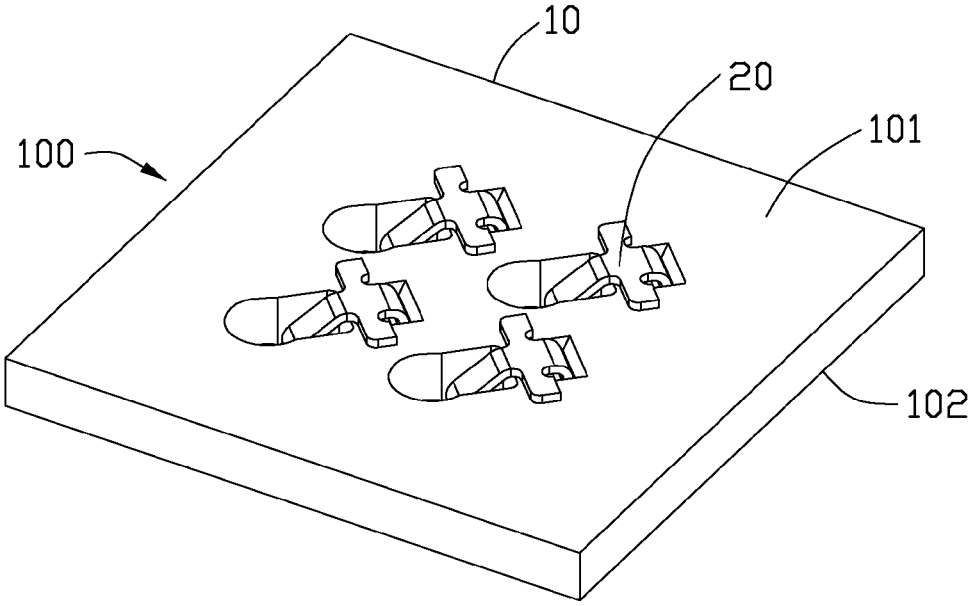
FIG. 1 is an assembly, perspective view of an electrical connector in accordance with a preferred embodiment of the present invention.

Reference will be made to the drawing figures to describe the present invention in detail, wherein depicted elements are not necessarily shown to scale and wherein like of similar elements are designated by same or similar reference numeral through the several views and same or similar terminology.

Figure 2:
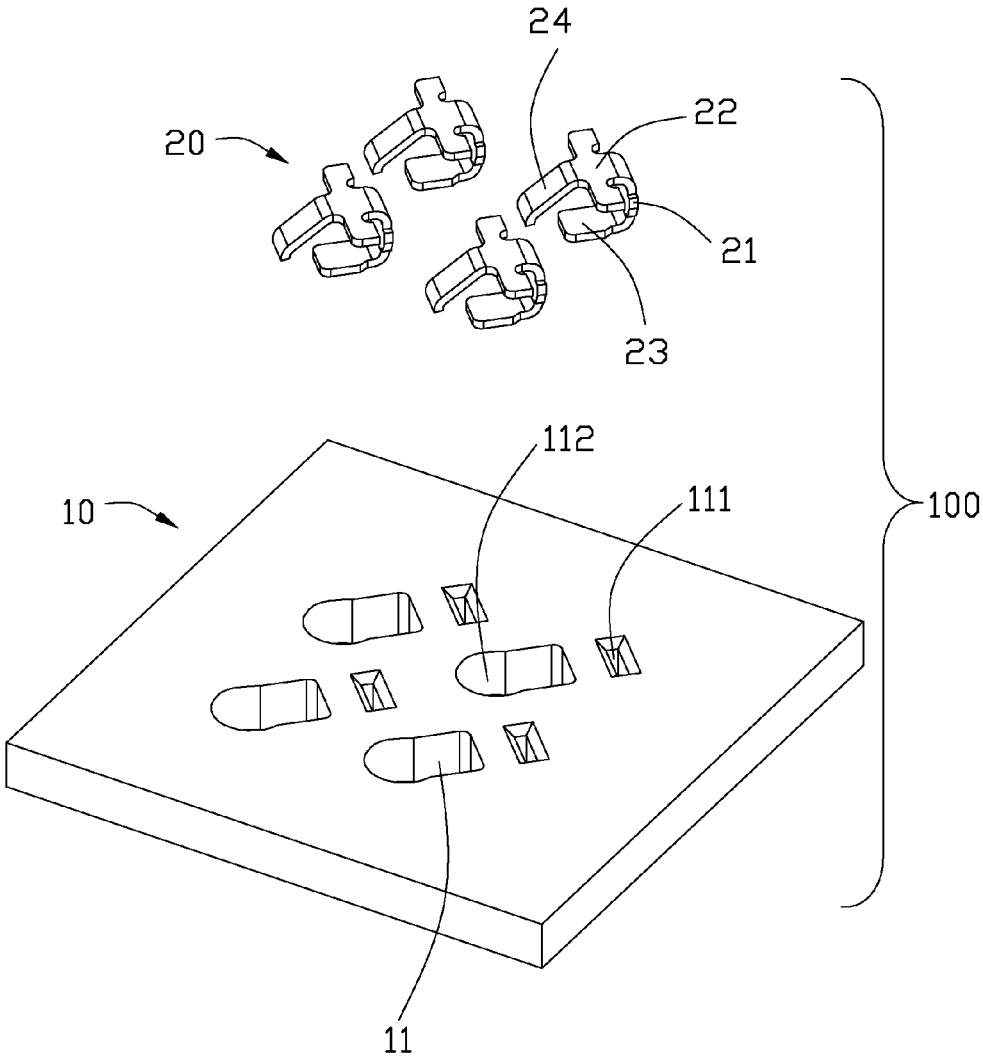
FIG. 2 is an exploded, perspective view of the electrical connector shown in FIG. 1.

Referring to FIGS. 1-2, according to a preferred embodiment of the present invention, an electrical connector 100 used for establishing electrical connection between an integrated circuit (IC, not shown) package 30 and a printed circuit board (PCB, not shown) is shown. The electrical connector 100 comprises an insulative housing 10 and a plurality of electrical contacts 20 secured thereto. The insulative housing 10 has a top surface 101 and a bottom surface 102 opposite to each other and defines a plurality of receiving holes 11 extending therethrough. The receiving hole 11 includes a first hole 111 and a second hole 112 separated from each other.

Figure 3:
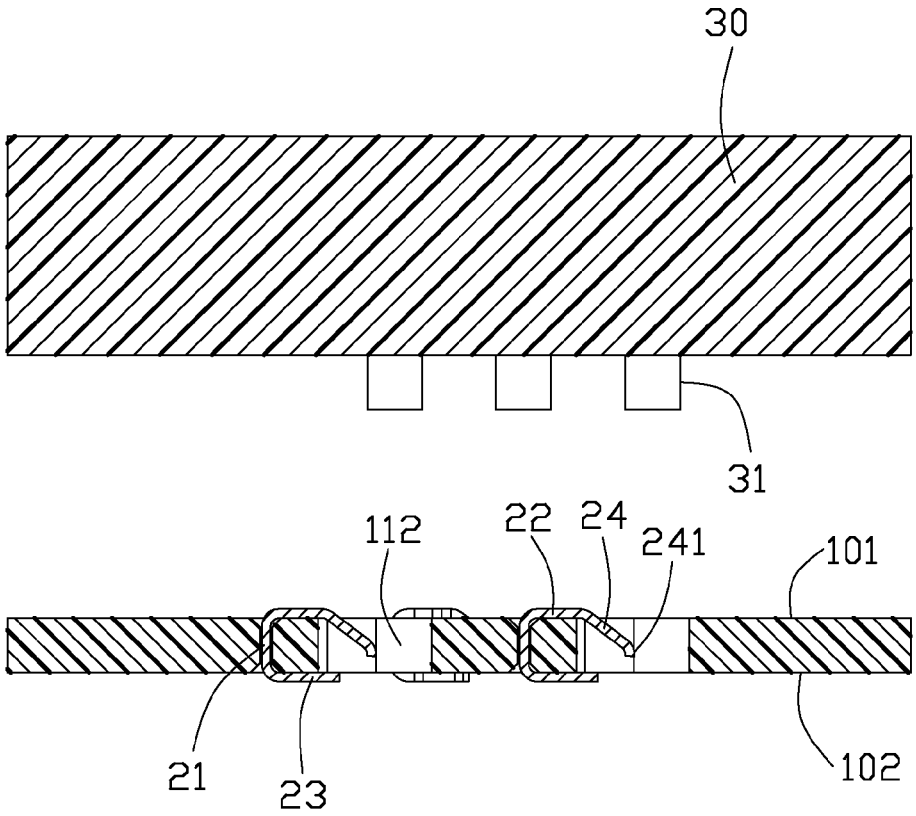
FIG. 3 is a sketch view of the electrical connector shown in FIG. 1 with an IC package detached from the electrical connector.

Please refer to FIGS. 2 to 3, each electrical contact 20 includes a retaining section 21, a flat offset section 22 bending from a top end of the retaining section 21, a soldering section 23 bending from a bottom end of the retaining section 21, and a cantilevered contact arm 24 bending downwardly from the offset section 22 and projecting into the receiving hole 11. The offset section 22 extends along the top surface 101 of the insulative housing 10 and in a horizontal plane. The retaining section 21 is located in a vertical plane and perpendicular to the offset section 22. The solder section 23 is located out of the insulative housing 10 and parallel to the offset section 22.

The contact arm 24 first deviates from the retaining section 21 and then bends approach the retaining section 21 thereby forms a contact tip 241 located in the receiving hole 11 for contacting with pin 31 of the IC package 30. The offset section 22, the contact arm 24 and the solder section 23 are located at a same side of the retaining section 21. Please refer to FIG. 3, the retaining section 21 and the contact tip 241 of the contact arm 24 form two outermost sides of the electrical contact 20 in a transversal direction.

Figure 4:
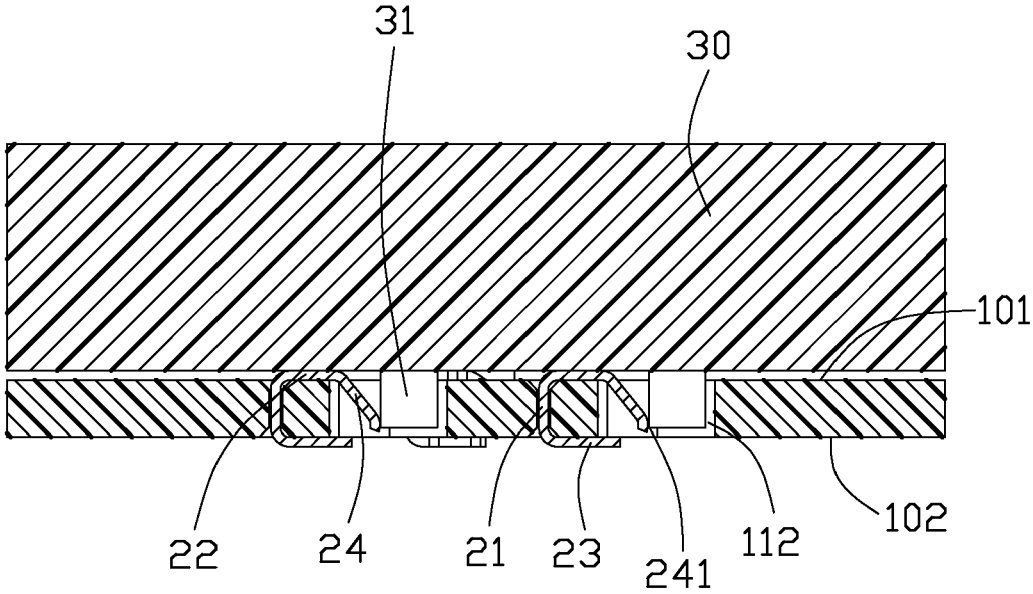
FIG. 4 is similar to FIG. 3 while the IC package is mating with the electrical connector.
Figure 5:
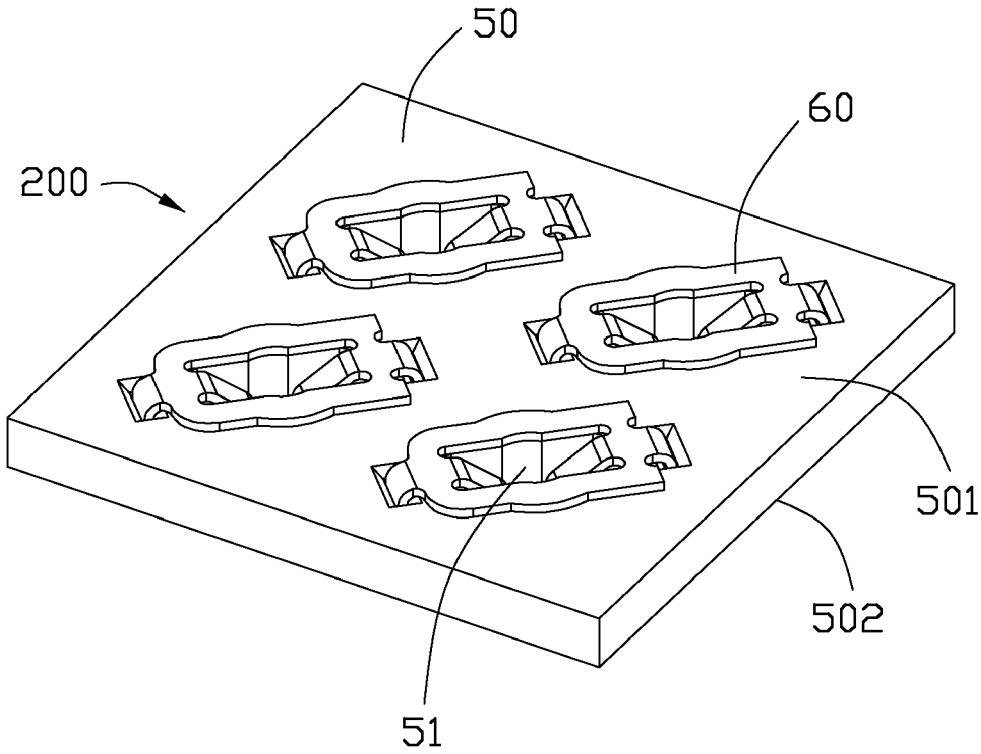
FIG. 5 is an assembly, perspective view of an electrical connector in accordance with a second preferred embodiment of the present invention.

After assembling, the retaining section 21 and the contact arm 24 are received in the first and second hole 111, 112, respectively. The offset section 22 and the solder section 23 are exposed to the top and bottom surfaces 101, 102 of the insulative housing 10, respectively. Since the offset section 22 is disposed on the top surface 101 of the insulative housing 10 and contacts therewith, the insulative housing 10 can support the offset section 22 in the vertical direction. Furthermore, please referring to FIG. 4, the top surface 101 of the insulative housing 10 can provide a fulcrum for the cantilevered contact arm 24 so that the contact arm 24 has a good elasticity.

In addition, the offset section 22 extends in a horizontal plane and further bends downwardly and obliquely so that the height of the insulative housing 10 is equal to the height of the retaining section 21 of the electrical contact 20 and less than the height of the electrical contact 20. Therefore, the height of the electrical connector 100 is equal to the height of the electrical contacts 20. The contacting arm 24 also could further extend from the contact tip 241 so as to contact with at least one of the solder section 23 and a solder (not shown) on the solder section 23.

FIGS. 5 to 8 show an electrical connector 200 according a second preferred embodiment of the present invention. The electrical connector 200 is used for establishing electrical connection between the integrated circuit (IC) package 3 and a printed circuit board (PCB, not shown). The electrical connector 200 comprises an insulative housing 50 and a plurality of electrical contacts 60 secured thereto. The insulative housing 50 has a top surface 501 and a bottom surface 502 opposite to each other and defines a plurality of receiving holes 51 extending therethrough. The receiving hole 51 includes a first hole 511, a second hole 512 and a third hole 513 separated from each other.

Figure 6:
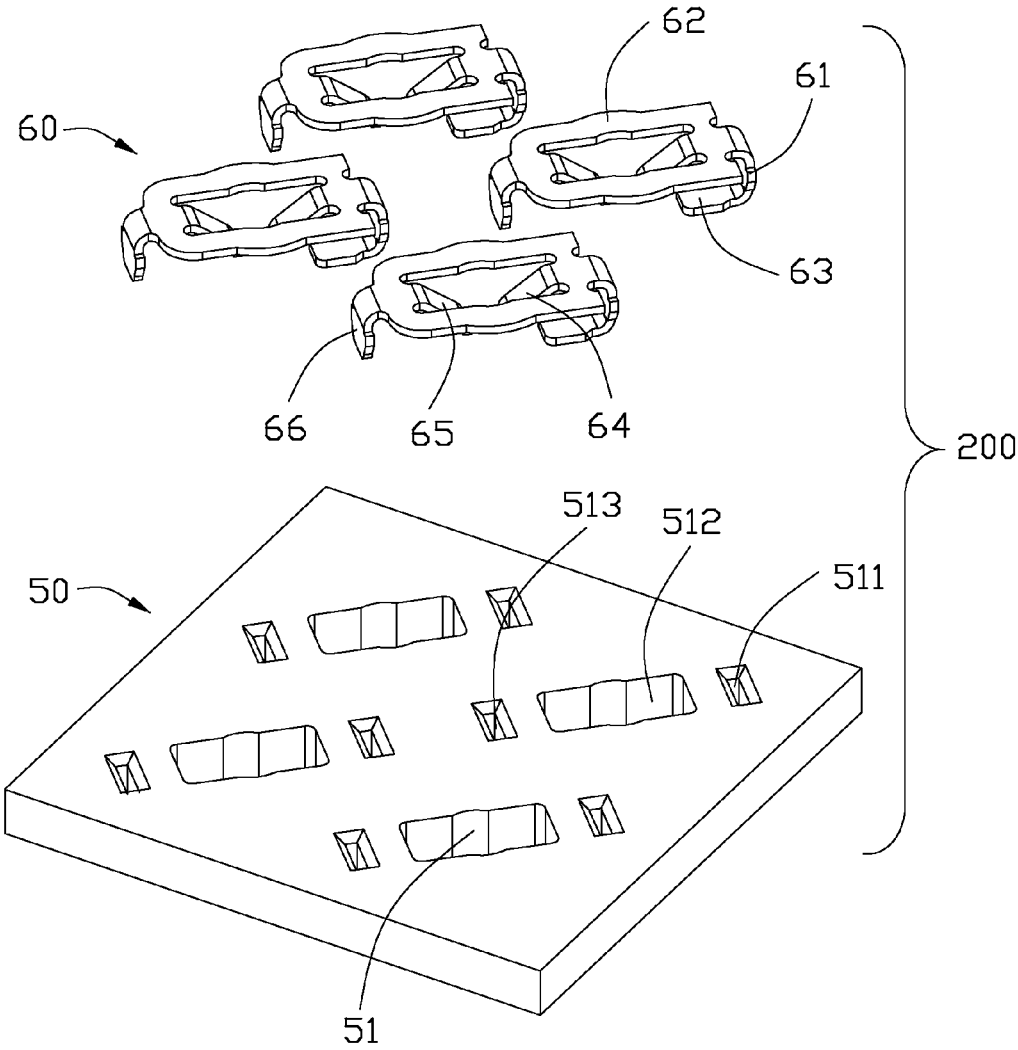
FIG. 6 is an exploded, perspective view of the electrical connector shown in FIG. 5.
Figure 7:
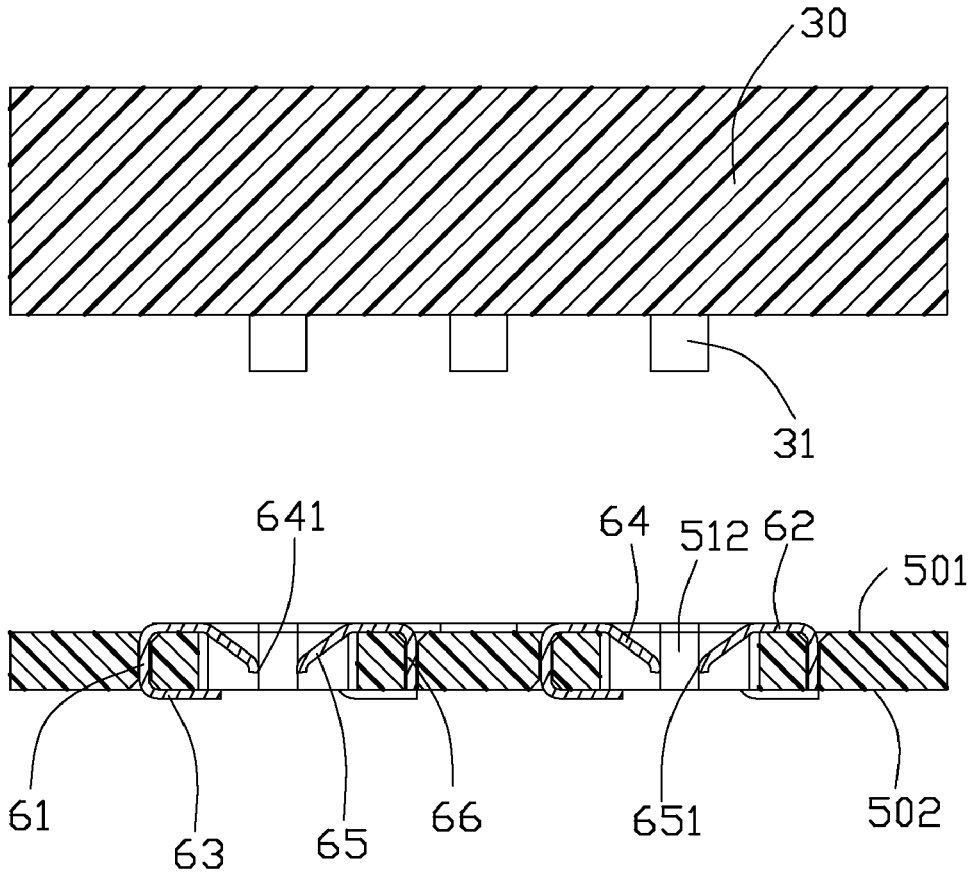
FIG. 7 is a sketch view of the electrical connector shown in FIG. 5 with an IC package detached from the electrical connector.
Figure 8:
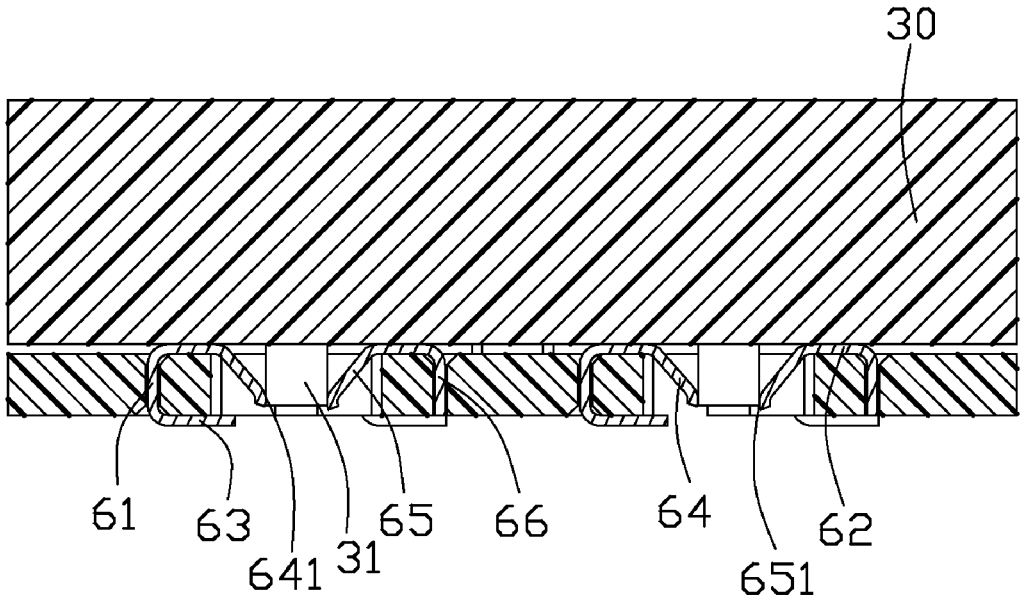
FIG. 8 is similar to FIG. 7 while the IC package is mating with the electrical connector.

Please refer to FIGS. 6 to 7, each electrical contact 60 includes a first retaining section 61, a flat offset section 62 bending from a top end of the first retaining section 61, a soldering section 63 bending from a bottom end of the first retaining section 61, and a second retaining section 66 bend downwardly from the offset section 62 and opposite to the first retaining section 61. A pair of cantilevered first and second contact arms 64, 65 bends downwardly from the offset section 62 and are symmetrical in the receiving hole 51. The offset section 62 extends along the top surface 501 of the insulative housing 50 and in a horizontal plane. The first and second retaining sections 61, 66 are located in a vertical plane respectively and perpendicular to the offset section 61. The solder section 63 is located out of the insulative housing 50 and parallel to the offset section 62.

The first contact arm 64 first deviates from the first retaining section 61 and then bends approach the first retaining section 61 thereby forms a first contact tip 641 located in the receiving hole 51 for contacting with a pin 31 of the IC package 30. The second contact arm 65 first deviates from the second retaining section 66 and then bends approach the second retaining section 66 thereby forms a second contact tip 651 located in the receiving hole 51 for contacting with the pin 31 of the IC package 30. The offset section 62, the contact arms 64, 65 and the solder section 63 are located between the first and second retaining sections 61, 66. Please refer to FIG. 7, the first retaining section and the second retaining section 61, 67 form two outermost sides of the electrical contact 60 in a transversal direction.

After assembling, the pair of retaining sections 61, 66 are received in the first and third holes 511, 513 respectively, and two contact arms 64, 65 are received in the second hole 512. The offset section 62 and the solder section 63 are exposed to the top and bottom surfaces 501, 502 of the insulative housing 50, respectively. Since the offset section 62 is disposed on the top surface 501 of the insulative housing 50 and contacts therewith, the insulative housing 50 can support the offset section 62 in the vertical direction. Furthermore, please referring to FIG. 8, the top surface 501 of the insulative housing 50 can provide two fulcrums for the cantilevered contact arms 64, 65 so that the contact arms 64, 65 have a good elasticity.

The offset section 62 extends in a horizontal plane and further bends downwardly and obliquely so that the height of the insulative housing 50 is equal to the height of the retaining sections 61, 66 of the electrical contact 60 and less than the height of the electrical contact 60. Therefore, the height of the electrical connector 200 is equal to the height of the electrical contacts 60. The contacting arms 64, 65 also can further extend from the contact tips 641, 651 so as to contact with at least one of the solder section 63 and a solder (not shown) on the solder section 63.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an insulative housing having a top surface and a bottom surface opposite to each other, the insulative housing defining a plurality of receiving holes extending therethrough; and a plurality of electrical contacts secured to the insulative housing, each electrical contact including a retaining section received in the receiving hole, an offset section bending from a top end of the retaining section and extending along the top surface of the insulative housing, a soldering section bending from a bottom end of the retaining section, and a cantilevered contact arm bending downwardly from the offset section and projecting into the receiving hole;

wherein the contact arm first deviates from the retaining section and then bends approach the retaining section thereby forms a contact tip in the receiving hole;

wherein the electrical contact further comprises another contact arm bending from the offset section, and the contact arms are received in the receiving hole, wherein the electrical connector comprises another retaining section and the retaining sections opposite to each other;

wherein the receiving hole includes a first hole, a second hole and a third hole separated from each other, and wherein the retaining sections are received in the first and third hole respectively, and the contact arms are received in the second hole.

2. An electrical connector for use with an electronic package, comprising:

an insulative housing defining plural sets of holes between opposite upper and bottom surfaces, each of the set of holes including a first hole and a second hole spaced and isolated from each other by the housing, the first hole being much smaller than the second hole; and a plurality of electrical contacts disposed in the housing, each of said contacts including a vertical retention section securely and snugly received in the corresponding first hole, a deflectable contacting section extending from an offset section, which extends from a top portion of the retention section and is exposed upon the upper surface to an exterior, and downwardly into the corresponding second hole, and a mounted section extending from a lower portion of the retention section and exposed upon the bottom surface; wherein said second hole is dimensioned to be large enough to receive a corresponding conductor of the electronic package and the deflectable contacting section of the corresponding contact; and wherein in each of said contacts, said retention section and said contacting section are essentially located by one side of the corresponding second hole, and another retention section and another contacting section are located by the other side of the corresponding second hole and connected to said retention section and said contacting section via a transverse bar which lies upon the upper surface.

3. The electrical connector as claimed in claim 2, wherein the mounting section extends horizontally along the bottom surface.

4. The electrical connector as claimed in claim 3, wherein said mounting section extends toward the corresponding second hole so as to cooperate with the offset section to sandwich the housing therebetween in a vertical direction.

* * * * *